US010418207B2

(12) United States Patent
Lantzsch et al.

(10) Patent No.: US 10,418,207 B2
(45) Date of Patent: Sep. 17, 2019

(54) ACTUATION DEVICE

(71) Applicant: VOLKSWAGEN AG, Wolfsburg (DE)

(72) Inventors: Volker Lantzsch, Meine (DE); Arne Bahns, Meine (DE); Mathias Müller, Gifhorn (DE); Richard Ludwig Schiemenz, Isenbüttel (DE)

(73) Assignee: Volkswagen AG (DE)

( * ) Notice: Subject to any disclaimer, the term of this patent is extended or adjusted under 35 U.S.C. 154(b) by 0 days.

(21) Appl. No.: 15/620,390

(22) Filed: Jun. 12, 2017

(65) Prior Publication Data

US 2017/0358409 A1 Dec. 14, 2017

(30) Foreign Application Priority Data

Jun. 14, 2016 (DE) ..... 10 2016 210 515

(51) Int. Cl.

| | |
|---|---|
| ***H01H 21/22*** | (2006.01) |
| ***H01H 19/14*** | (2006.01) |
| ***H01H 19/36*** | (2006.01) |
| ***H01H 19/54*** | (2006.01) |
| ***H01H 21/04*** | (2006.01) |
| ***H01H 19/62*** | (2006.01) |
| ***H01H 19/63*** | (2006.01) |

(Continued)

(52) U.S. Cl.

CPC ..... *H01H 21/22* (2013.01); *H01H 19/14* (2013.01); *H01H 19/36* (2013.01); *H01H 19/54* (2013.01); *H01H 19/62* (2013.01); *H01H 19/63* (2013.01); *H01H 21/04* (2013.01); *H01H 21/42* (2013.01); *H01H 13/506* (2013.01); *H01H 19/005* (2013.01); *H01H 21/30* (2013.01); *H01H 2205/016* (2013.01); *H01H 2231/026* (2013.01)

(58) Field of Classification Search

CPC ..... H01H 23/146; H01H 23/16; H01H 23/12; H01H 23/168; H01H 23/143; H01H 23/30; H01H 19/635; H01H 2021/225; H01H 2300/01; H01H 21/24; H01H 21/50; H01H 23/025; H01H 25/041; H01H 11/0018; H01H 13/52; H01H 13/702; H01H 15/102; H01H 1/16; H01H 2221/016

USPC ..... 200/339, 331, 401, 4, 17 R, 315, 316, 200/336

See application file for complete search history.

(56) References Cited

U.S. PATENT DOCUMENTS 6,011,228 A * 1/2000 Leng ..... H01H 21/245 200/523
2009/0107820 A1* 4/2009 Michel ..... H01H 21/24 200/339

FOREIGN PATENT DOCUMENTS

DE 2434272 A1 2/1976
DE 4237724 C1 12/1993

(Continued)

*Primary Examiner* — Ahmed M Saeed
(74) *Attorney, Agent, or Firm* — Barnes & Thornburg LLP

(57) ABSTRACT

An actuating apparatus having a signal transmitter and a mechanical operating element, wherein the mechanical operating element includes a first position that is stable over time and a second position that is stable over time, wherein the mechanical operating element, in the case of a movement from the first position that is stable over time into the second position that is stable over time, actuates the signal transmitter, and wherein the signal transmitter, upon actuation, causes a first signal change followed by a second signal change of an output signal, and an evaluation circuit detects an actuation of the mechanical operating element based on the first signal change and the second signal change.

10 Claims, 9 Drawing Sheets

(51) Int. Cl.

| | |
|---|---|
| ***H01H 21/42*** | (2006.01) |
| *H01H 13/50* | (2006.01) |
| *H01H 19/00* | (2006.01) |
| *H01H 21/30* | (2006.01) |

(56) References Cited

FOREIGN PATENT DOCUMENTS

| | | | |
|---|---|---|---|
| DE | 10254992 | A1 | 6/2004 |
| DE | 69932799 | T2 | 8/2007 |
| DE | 102006029695 | A1 | 1/2008 |
| DE | 102006052739 | A1 | 5/2008 |

* cited by examiner

ACTUATION DEVICE

PRIORITY CLAIM

This patent application claims priority to German Patent Application No. 10 2016 210 515.9, filed 14 Jun. 2016, the disclosure of which is incorporated herein by reference in its entirety.

SUMMARY

Illustrative embodiments relate to an actuating apparatus, for example, for operating functions in a vehicle.

BRIEF DESCRIPTION OF THE DRAWINGS

The disclosed embodiments are described herein in detail with reference to the attached drawings.

FIG. 5 illustrates a possible movement progression between two positions of the disclosed apparatus, in accordance with the exemplary embodiment illustrated in FIG. 4, wherein the part figures

DETAILED DESCRIPTION

Figure 1:
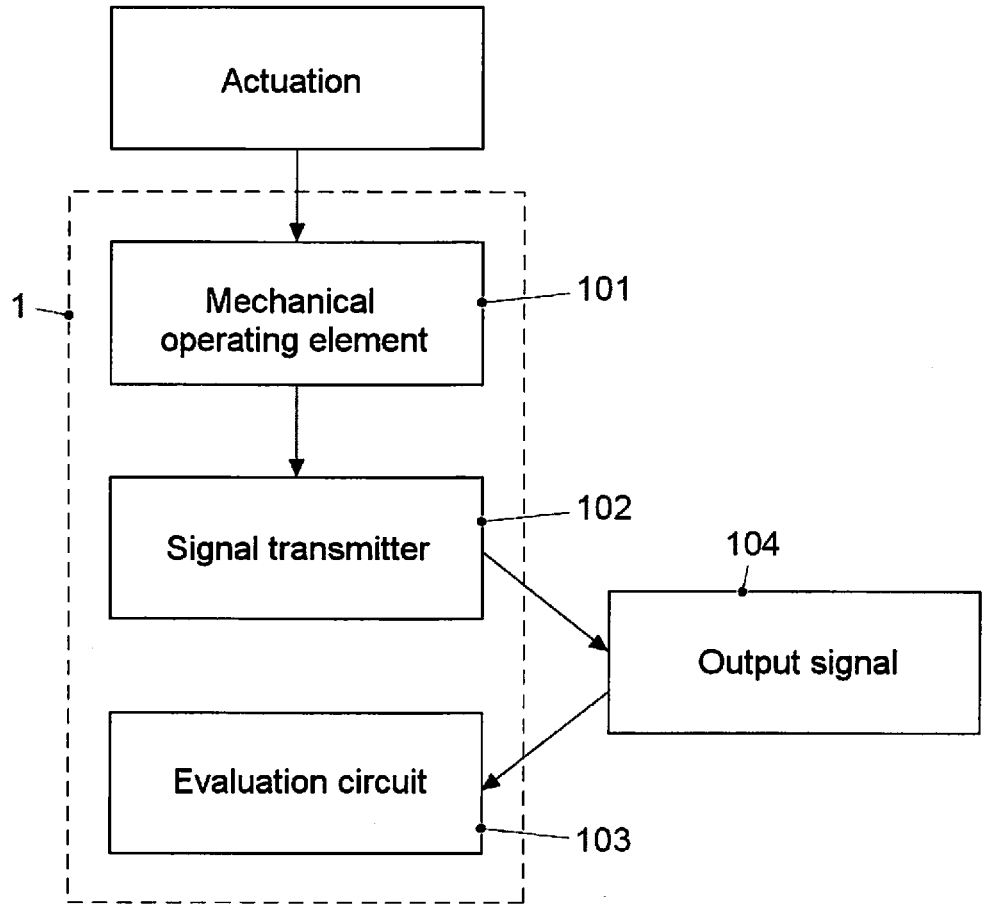
FIG. 1 illustrates the functional principle of a disclosed apparatus.

DE 10 2006 029 695 A1 discloses an actuating apparatus for electronic switches that can be used, for example, in motor vehicles. The apparatus comprises a mechanical actuating device and electronic switching elements that can be arranged on a circuit board. The circuit board is mechanically decoupled in at least one direction by an actuating lever.

In an embodiment of the apparatus in accordance with DE 10 2006 029 695 A1, the actuating device comprises at least one operating lever and at least one transmission lever that is articulated to the operating lever and acts on the switching element. This produces an actuating device, wherein the switching elements on the circuit board are not actuated directly but rather are only switched by way of a lever system.

DE 24 34 272 A1 relates to an actuating device according to the preamble of Claim 1 and relates in principle to electric switches having a contact spring that is supported at both ends in the housing by means of resilient ends that are embodied as contact limbs and bend inwards. Each contact arm cooperates with one of two fixed contacts that are to be bridged. As a switch is actuated, a contact is closed for a short time.

In accordance with the document, electric switches of the type mentioned in the introduction are disclosed that are however equipped with an operating element in lieu of an actuating plunger, wherein the operating element can be rotated or pivoted and it is possible to achieve short actuating paths and/or rapid switching movements. This is achieved by virtue of the fact in the case of the disclosed electric switches a curvature of the contact spring has the shape of a tooth and the tooth faces away from the fixed contacts and cooperates with a mating tooth that is mounted in a rotatable or pivotable manner in the housing. The switching movement of the mating tooth that extends in the direction or rotation is transmitted to the tooth of the contact spring, as a consequence of which the tooth of the contact spring deflects downwards and this causes the contact spring to bend resulting in the fixed contacts being bridged.

DE 10 2006 052 739 A1 relates to a method for safely and reliably controlling actuators, sensors or consumers in an electrical device that comprises the actuators, sensors or consumers. Upon being actuated, a button can output a pulse signal. In a control unit, the pulse signal is checked as to whether it is generated in a proper manner. The pulse signal is checked as to whether it is transmitted for a duration that is less than a fixed duration. It is thus possible by checking the pulse signal to establish whether the button is functioning in the proper manner or whether as a result of a malfunction a pulse signal is not being transmitted or a continuous signal is being transmitted, by way of example as a result of the button becoming so-called stuck.

DE 699 32 799 T2 discloses a rotary switch that is a type of electric switch, such as, for example, are used in motor vehicles.

The switch comprises a housing that is positioned in front of a fascia, for example, a dashboard in a motor vehicle. The switching in the housing is intended to be set in rotational movement in a plane parallel to this fascia to control a function, for instance, in a motor vehicle.

The disclosed rotary switch comprises a drive element having at least a rear end piece that is suitable for moving between an idle position and a first position, wherein likewise a restoring device is disclosed that forces the end piece and the housing to move back into their idle position.

Document DE 42 37 724 C1 discloses an electric switch that is essentially embodied from a housing, which is produced from a synthetic material, an actuating element that is embodied as a type of rocker and is mounted in a pivotable manner on the housing, and two contact rockers, which can be influenced by means of the switching pieces that are an integral part of the actuating element, and also a base part that receives the fixed electrical contact parts.

In accordance with the document, a stable middle switching position and two so-called button positions are provided for the actuating element or the two contact rockers.

U.S. Pat. No. 5,597,989 discloses a switching device that comprises a stationary contact and a movable contact element, wherein the movable contact element comprises on both sides a pair of limbs, by means of which the movable contact piece is moved back and forth and as a consequence is brought into or out of engagement with the stationary contact.

Document DE 102 54 992 B4 discloses likewise an electric switch having a housing that comprises a base and a cover. The switch comprises in addition a fixed contact and a switching contact, wherein the switching contact is fastened to a rocker switch and wherein the rocker switch can be pivoted between two rocker positions that correspond to the switching positions, and wherein a restoring element in the starting position influences the rocker switch in such a manner that the rocker switch is held in a latching manner in one of the two rocker positions, and is characterized in that lugs are arranged on the base as counter bearings for the restoring element and the rocker switch is received between the lugs.

Operating elements of an actuating apparatus, the operating elements being switches or buttons, are generally used by way of example as input components of control units in motor vehicles.

In the context of this application, buttons are operating elements that after being actuated by a user return to their starting position, such as, for example, a bell button, yet upon actuation abandon the starting state, temporarily (depending upon the design for a short time) assume a different intermediate state and after being actuated return into the starting state or can however assume a further third end state.

In so doing, the "state" can be an optical, electrical, magnetic or electromagnetic state. An electrical state can be by way of example an electrical potential at the input contact or output contact in the case of voltage-driven operating elements or a specific, defined current flow at an input contact or output contact, in the case of current-driven operating elements.

Switches are operating elements that do not return to their starting position after being actuated but rather remain in their new position, such as, for example, toggle switches or rotary switches, and in the case of being actuated from an electrical starting state change permanently into a different electrical end state.

Operating elements can comprise a mechanical or electrical button characteristic. In the case of operating elements having a mechanical button characteristic, the operating element returns to its starting position after being actuated. In the case of operating elements having an electrical button characteristic, the actuation of the operating element causes a change of state of the electrical signal, wherein this change of state only exists for the duration of the actuation.

An electromagnetic signal transmitter having a button characteristic is an electromechanical component, wherein by means of the mechanical actuation (pressing) causes a change of state of the electrical signal and the change of state likewise exists only for the duration of the actuation. In contrast, an operating element having a switch characteristic is an electromechanical component, wherein a mechanical actuation produces a permanent change of state of the electrical signal. The state of the electrical signal only experiences a change when a subsequent actuation is performed.

It is not always desirable or expedient to use a button as an operating element, for example, when the design and/or the tactile feedback of a button are undesirable. It is therefore desirable to use an operating element having a switch characteristic in such a manner that it behaves in an electrical manner like a button.

The behavior of a button is characterized by means of two signal changes of the electrical output signal, the signal changes being performed in opposite directions and chronologically one after the other. This renders it possible to use operating elements having a switch characteristic, by way of example a switch.

Disclosed embodiments provide an actuating apparatus that comprises an output signal with a button characteristic and comprises an operating element that is not embodied as a button. This is achieved by the disclosed actuating apparatus.

The disclosed apparatus comprises a signal transmitter and a mechanical operating element. The mechanical operating element comprises a first position that is stable over time and a second position that is stable over time and the mechanical operating element is embodied so as to actuate the signal transmitter in the case of a movement from the first position that is stable over time into the second position that is stable over time. The signal transmitter is embodied so as upon actuation to cause a first signal change followed by a second signal change of an output signal. The disclosed device comprises an evaluation circuit that is embodied so as to detect an actuation of the mechanical operating element on the basis of the first signal change and the second signal change.

The electrical output signal is in a first signal state when the signal transmitter is not actuated and changes into a second signal state when the signal transmitter is actuated.

The term 'the first signal change' is understood to mean the transition from the first signal state to the second signal state.

While the signal transmitter is actuated, the electrical output signal remains in the second signal state and only changes into the first signal state when the signal transmitter is released. The second signal change can be a transition from the second signal state into the first signal state or into a third signal state that is different from the first signal state.

A position that is stable over time is a position in which the mechanical operating element remains if external forces are not acting upon the operating element, in other words in the absence of the influence of force it remains in this position.

By virtue of actuating the signal transmitter by means of the mechanical operating element and detecting the mechanical actuation by means of the evaluation circuit, it is rendered possible that mechanical operating elements behave, for example, as operating elements that have a switch characteristic, such as, for example, buttons.

The actuation of the signal transmitter by a user causes the signal transmitter to be actuated for a short period of time and it can subsequently return to its idle position.

Each actuation of the signal transmitter causes a first signal change and a second signal change of the electrical output signal. As a consequence, a predetermined actuation of the signal transmitter is performed at a peak point.

In accordance with the disclosed embodiments, a peak point is the point at which the signal transmitter is actuated by means of an actuation, for example, by means of a mechanical actuation.

In accordance with the above discussed embodiment, the signal transmitter is always actuated in the same manner, as a consequence of which a redundant output signal of the signal transmitter can be provided. It is therefore possible to considerably simplify the evaluation of the output signal, for example, using software, for example, by means of evaluation software that is integrated in a vehicle.

In accordance with at least one disclosed embodiment, the output signal can assume optical, electrical, magnetic or electromagnetic states.

An electrical state can be by way of example an electrical potential at an input contact or output contact in the case of voltage-driven operating elements or a specific, defined current flow at an input contact or output contact in the case of current-driven operating elements.

The temporal interval between the first signal change and the second signal change lies within a predetermined range.

By virtue of the double signal change of the electrical output signal as a result of the mechanical operating element being actuated, the signal transmitter after termination of the actuation is back in the same state as before the actuation. It is thus not necessary to perform an additional diagnosis, for example, by means of an evaluation device by way of example in a vehicle, so as to determine the state of the signal transmitter after the actuation.

In accordance with at least one disclosed embodiment, the predetermined ranges can lay within ±20%, for example, ±5% about a predetermined temporal interval.

It is rendered possible to detect in a redundant manner the position of the mechanical operating element, such as, for example, a switch.

Moreover, the disclosed apparatus comprises means for preventing an actuating time of the signal transmitter that lies outside the predetermined range.

The prevention means can ensure that an electrical contact, for example, a button, is closed for a short as possible time period. The contact can thus be closed for such a short time period that the output signal of the signal transmitter corresponds to a defined and reproducible value.

In accordance with at least one disclosed embodiment, the mechanical operating element can comprise an operating lever and prevention means can comprise a mounting arrangement, a sleeve, a spring, a receiving arrangement, a roller wheel, a running track and an actuating cam, wherein the operating lever can be mounted on the sleeve by way of the mounting arrangement, wherein the sleeve can comprise the spring, wherein the spring can be connected by way of a receiving device to the roller wheel, wherein the roller wheel can move freely in the running track between the first position that is stable over time and the second position that is stable over time, wherein during the transition from the first position that is stable over time to the second position that is stable over time the roller wheel can pass by an actuating cam that is mounted on the running track.

In accordance with at least one disclosed embodiment, the roller wheel can be coupled to a release device, wherein the release device can be connected to an electrical jumper having a housing, wherein the electrical jumper can comprise electrical contacts in the housing.

The roller wheel can be guided by way of the running track to an actuating cam, wherein the actuating cam actuates the electrical jumper by way of a release device. The actuation of the electrical jumper causes the contact between a first electrode and a second electrode of the signal transmitter to close.

In accordance with at least one disclosed embodiment, the electrical jumper can be closed at a peak point in the case of a movement of the operating lever from the first position that is stable over time into the second position that is stable over time.

By virtue of the means for preventing an period outside the predetermined range and the associated embodiments discussed above actuation time, a mechanical operating element, such as, for example, a switch, cannot be held manually at the peak point by a user.

The switch is automatically moved into the second position that is stable over time, as a consequence of which a signal transmitter, which is operated by way of example by means of the switch, is actuated only during a short period of time. Consequently, the electrical jumper is actuated for a short period of time.

In accordance with at least one disclosed embodiment, the mechanical operating element comprises a toggle switch that can be connected by way of a mounting arrangement to an actuating cam, wherein the actuating cam can be embodied so as to actuate the signal transmitter.

The toggle switch can change from the first position that is stable over time by means of a mechanical actuation into a second position that is stable over time, wherein the toggle switch passes through a peak point and remains at the peak point only for the duration of the switch over.

In accordance with at least one disclosed embodiment, the mechanical operating element can comprise a rotary switch.

In accordance with at least one disclosed embodiment, the rotary switch can comprise a multiplicity of positions that are stable over time.

In accordance with at least one disclosed embodiment, the rotary switch can comprise a profiled carrier, wherein the profiled carrier can comprise a radial cam profile or an axial cam profile, wherein the radial cam profile and the axial cam profile can comprise a multiplicity of actuating cams.

By virtue of the possibility of the radial and axial arrangement of the cam profile, a multiplicity of application options are provided, such as, for example, different assembly options and embodiments of the rotary switch in a vehicle.

In accordance with at least one disclosed embodiment, the rotary switch can be moved around an axis of rotation by means of a rotary wheel.

This disclosed embodiment of the apparatus renders it possible to have various tactile designs of the operating elements, such as, for example, operating elements in a vehicle, which enables the customer to use the operating elements intuitively when defining the vehicle functions.

In accordance with at least one disclosed embodiment, the rotary switch can be embodied so as to perform a rotary movement, wherein the actuating cams of the radial cam profile or the actuating cams of the axial cam profile are embodied so during the rotary movement to actuate the signal transmitter in the case of a transition from at least a first position that is stable over time to a second position that is stable over time.

In accordance with at least one disclosed embodiment, the signal transmitter can comprise a membrane key or a micro button or a push button but is not limited thereto.

It is possible to use already available components in the case of this embodiment, as a consequence of which additional hardware changes to existing control units are not required, as a consequence of which it is possible to avoid additional costs.

An actuating cam can actuate the signal transmitter by virtue of rotating the profiled carrier. As a consequence of which, an electrical signal is output, in other words the signal transmitter is always actuated when an actuating cam of the profile carrier passes over the signal transmitter. A redundant output signal is output even when a multiplicity of actuating cams actuates the signal transmitter. Additional software, for example, software that is integrated in a vehicle would in this case assume the control of the individual output signals.

Exemplary embodiments are explained in detail hereinunder with reference to the attached drawings. These exemplary embodiments represent only examples and are not to be regarded as limiting.

Whereas by way of example the exemplary embodiments are described in such a manner that they comprise a multiplicity of features and elements, some of these features can be omitted in other exemplary embodiments and/or be replaced by alternative features of elements. It is possible in other exemplary embodiments to provide additional or alternative additional features or elements in addition to those explicitly described. Modifications that relate to one or more exemplary embodiments can also be applied to other exemplary embodiments unless otherwise stated.

FIG. 1 illustrates the functional principle of the apparatus in accordance with at least one exemplary embodiment, wherein the apparatus 1 comprises a mechanical operating element 101, a signal transmitter 102 and an evaluation circuit 103. The mechanical operating element 101 comprises at least a first position that is stable over time and a second position that is stable over time and can comprise further positions. The mechanical operating element 101 is embodied so as to actuate the signal transmitter 102 in the case of a movement from the first position that is stable over time into the second position that is stable over time. The signal transmitter 102 is embodied so as upon actuation to cause two changes in the signal state of the output signal 104. The evaluation circuit 103 is embodied so as to detect an actuation of the mechanical operating element 101 on the basis of the change in the signal state of the output signal.

Figure 2:
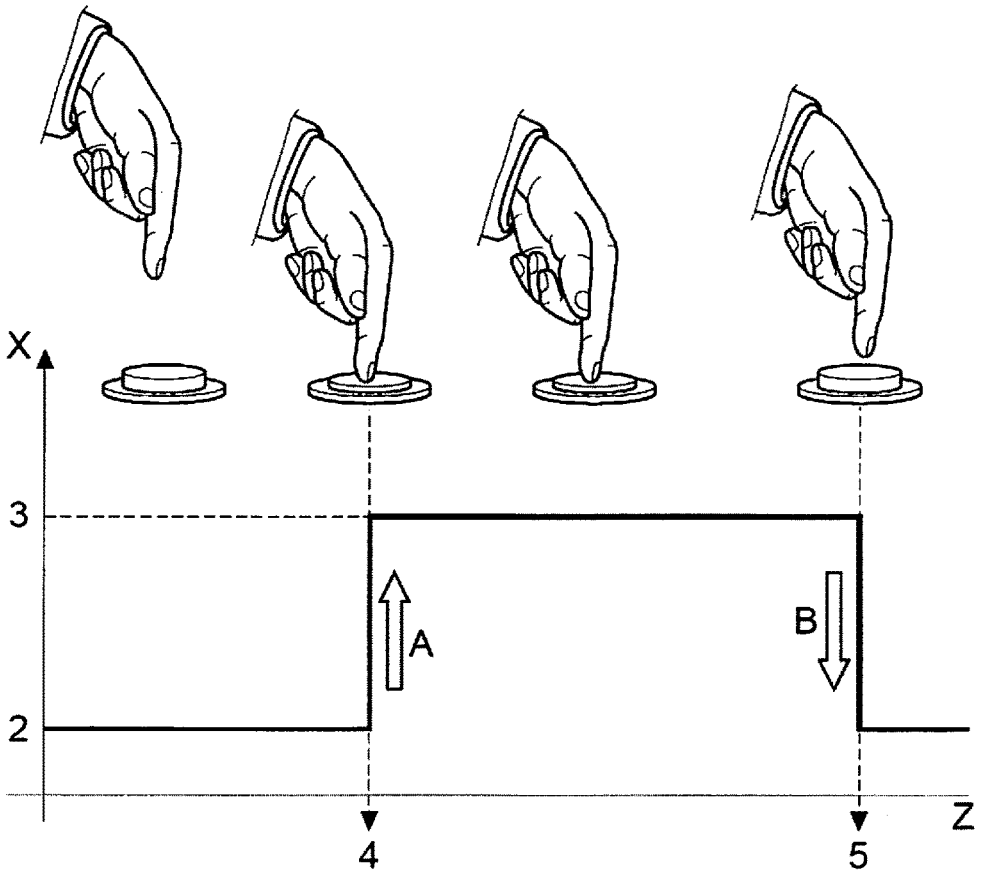
FIG. 2 illustrates the basic behavior of an electrical signal of a button for explaining the exemplary embodiments.

FIG. 2 illustrates for the purpose of further explanation the basic behavior of an electrical signal of a button, wherein the button is mechanically actuated by a user. The individual actuating operations of the button are illustrated in FIG. 2, wherein the behavior of an electrical signal during the actuating operations in a coordinate system is illustrated, wherein the ordinate axis represents the signal states X of the electrical signal and wherein the time Z is plotted on the X axis.

The electrical signal is in a first signal state 2 when the button is not actuated by the user, in other words if the button is not pressed. By virtue of the user actuating the button, in other words the button is pressed at a first point in time 4, the electrical signal changes into a second signal state 3, wherein the transition from the first signal state 2 into the second signal state 3 defines a first signal change A.

While the button is actuated by the user, in other words is held down, the electrical signal remains in the second signal state 3 and only changes into the signal state 2 by releasing the button at a second point in time 5, wherein the transition from the second signal state 3 into the first signal state 2 defines a second signal change B.

The electrical signal illustrated in FIG. 2 thus performs a first signal change A which corresponds to a first signal flank when the button is pressed and a second signal change B that corresponds to a second signal flank when the button is released.

The behavior of a button is generally characterized by two signal flanks that work in the opposite direction and follow one another chronologically, in other words the electrical signal of the button in FIG. 2 experiences a signal flank change.

The temporal interval between the two signal flanks in the disclosed embodiment in FIG. 2 can be any length as desired depending upon how long the user intends to hold down the button. However, to achieve a reproducible signal behavior, in other words a constant temporal interval between the first signal change A and the second signal change B in FIG. 2, it is desirable to have a defined actuation of the button, in other words independently of the user.

Figure 3:
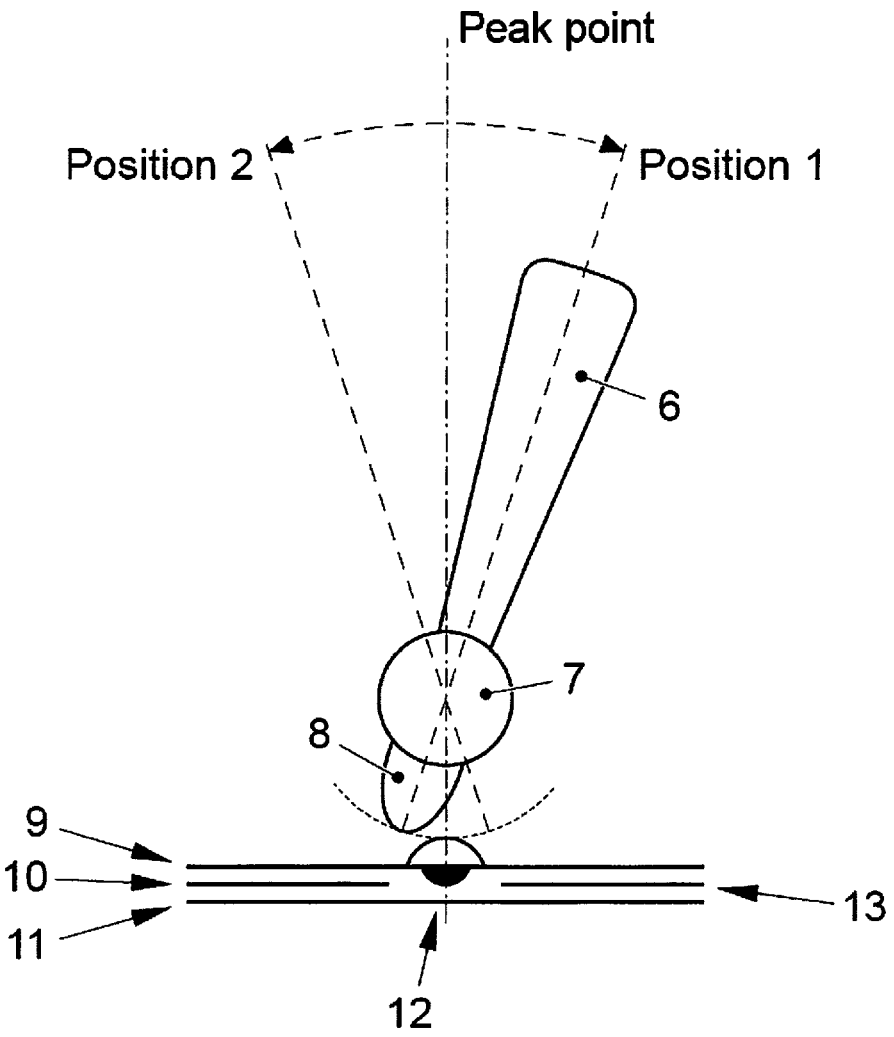
FIG. 3 illustrates a schematic illustration of a disclosed apparatus.

In the case of the exemplary embodiment of the apparatus illustrated in FIG. 3, the toggle switch 6 is connected by way of a mounting arrangement 7 to an actuating cam 8. A first electrode 9 that is connected by means of an insulator 10 to a second electrode 11, wherein the first electrode 9 comprises a contact nipple 12. The first electrode 9, the insulator 10, the second electrode 11 and the contact nipple 12 form together a membrane key 13. The toggle switch 6 can actuate the membrane key 13 by way of the actuating cam 8.

The toggle switch 6 can actuate different types of signal transmitters, for example, a micro button or a push button and is not limited to a membrane key.

The toggle switch 6 in FIG. 3 can change from position 1 (first position that is stable over time) by means of a mechanical actuation, for example, by means of the mechanical actuation by a use, into a position 2 (second position that is stable over time).

A position that is stable over time is in so doing defined as a position in which the toggle switch does not move without the influence of an external force.

As a result of the movement, the toggle switch 6 passes through a peak point, wherein the toggle switch 6 remains at the peak point only for the duration of the switch over.

At the peak point, the first electrode 9 experiences a mechanical pressure, as a consequence of which the contact nipple 12 that is fastened to the first electrode 9 is pushed in the direction of the second electrode 11 and thus a contact is produced between the first electrode 9 and the second electrode 11.

The toggle switch 6 is not limited to being switched over from position 1 to position 2. The above described behavior of the toggle switch 6 when switching from position 1 to position 2 is just the same when switching from position 2 to position 1.

Figure 4:
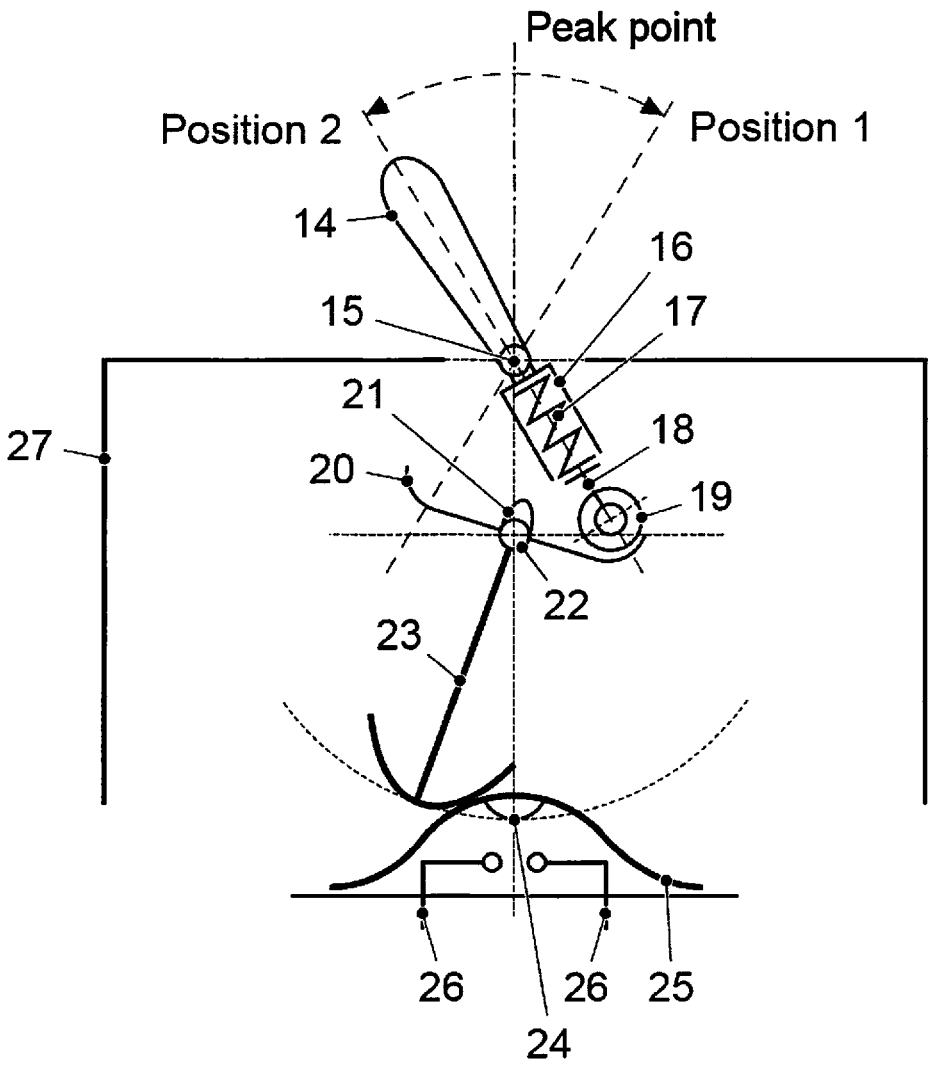
FIG. 4 illustrates a schematic illustration of another disclosed apparatus.

FIG. 4 illustrates a schematic illustration of an apparatus in accordance with a further exemplary embodiment of the apparatus, wherein an operating lever 14 is mounted on a sleeve 16 by way of a mounting arrangement 15.

The sleeve 16 comprises a spring 17 that is connected to a roller wheel 19 by way of a receiving arrangement 18, wherein the roller wheel 19 moves freely in a running track 20 between a position 1 (first position that is stable over time) and a position 2 (second position that is stable over time).

The roller wheel 19 passes an actuating cam 21, which is fastened to the running track 20, during the transition from the first position that is stable over time into the second position that is stable over time. The roller wheel 19 is coupled to a release device 23 by way of a mounting arrangement 22. The release device 23 is coupled by means of an electric jumper 24 to a housing 25. The electric jumper 24 in a housing 25 comprises electrical contacts 26.

The elements of the apparatus in FIG. 4 are installed in a housing 27, wherein the operating lever is fastened outside the housing 27. It is possible to switch the operating lever 14 in FIG. 4 between the first position that is stable over time and the second position that is stable over time and conversely.

FIG. 5 illustrates a movement progression of the apparatus illustrated in FIG. 4 when the apparatus is mechanically actuated, wherein the part figures FIG. 5*a*-5*g* represent the individual positions of the movement progression.

Figure 5A:
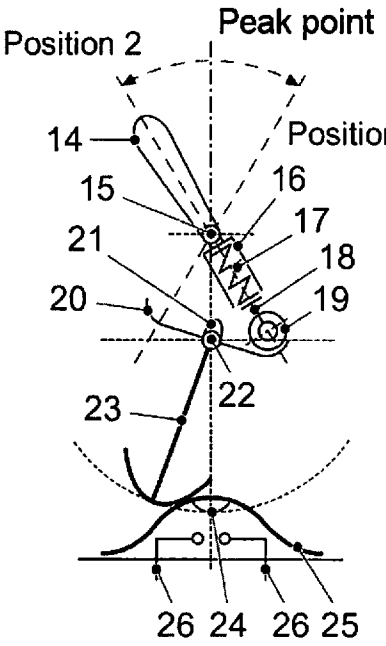
FIGS. 5*a*-5*g* illustrate the individual positions of the movement progression.
Figure 5B:
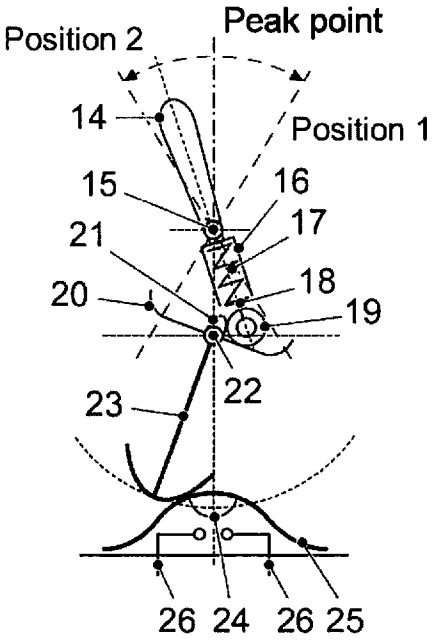

In FIG. 5*a*, the operating lever 14 is located in a first position that is stable over time. By virtue of the actuation, for example, by virtue of a mechanical actuation by a user, the operating lever 14 is deflected outwards, as illustrated in FIG. 5*b*, wherein the roller wheel 19 is guided in the running track 20 in the direction of the actuating cam 21, wherein as a result the receiving arrangement 18 pushes the spring 17 into the sleeve 16 and consequently pretensions the spring 17.

Figure 5C:
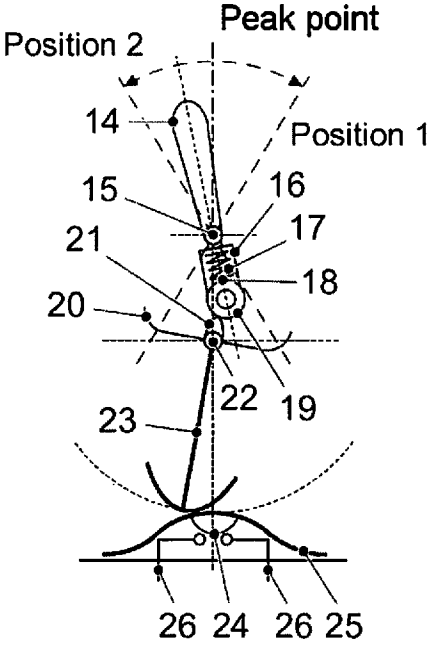

A further deflection of the operating lever 14, as is illustrated in FIG. 5*c*, results in a further movement of the roller wheel 19 in the running track 20 in the direction of the actuating cam 21, wherein the tension in the spring 17 further increases and wherein the release device 23 is moved in the direction of the electrical jumper 24 but an electrical connection is not produced between the contacts.

Figure 5F:
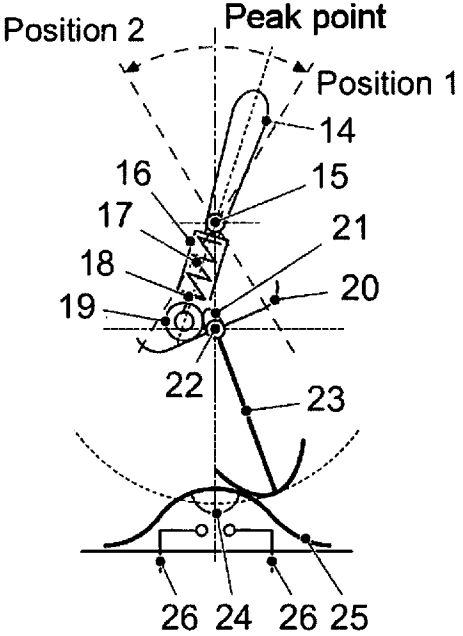
Figure 5E:
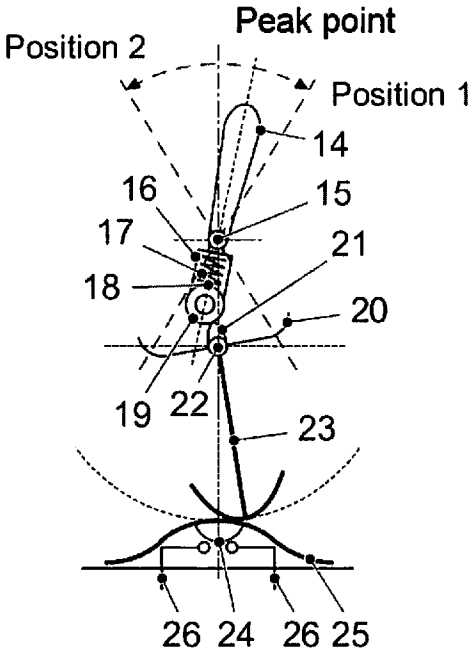
Figure 5D:
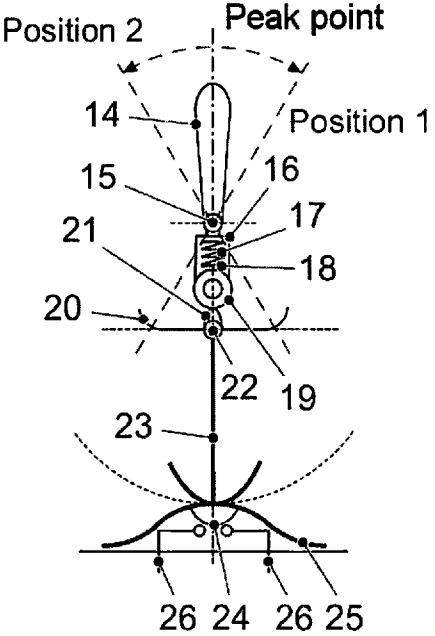

By virtue of achieving the peak point illustrated in FIG. 5*d*, in other words the point at which the operating lever 14 and the release device 23 are in line, in other words when the operating lever 14 is at an angle of less than or greater than 0° with respect to the release device 23, the two contacts 26 are closed as a result of the pressure in the direction of the electrical jumper 24, in other words the contact is closed which generates an electrical signal.

As soon as the roller wheel 19 has passed the peak point, the pretensioned spring 17 pushes the roller wheel 19 in the direction of position 2, as is illustrated in FIG. 5*e*.

The geometry of the roller wheel 19, in other words the size and its round shape, ensure in conjunction with the pretensioned spring 17, as is illustrated in FIG. 5*d* and FIG. 5*e*, for a very short dwell time at the peak point, in other words the jumper is closed for a short period of time.

Figure 5G:
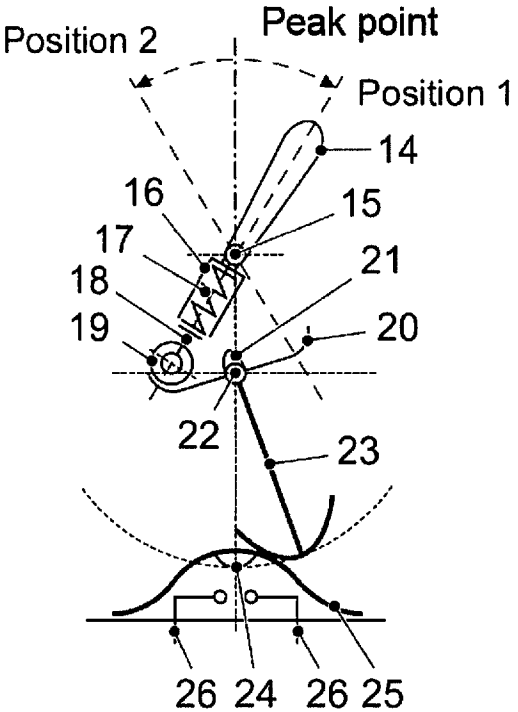

As illustrated in FIG. 5*f*, the spring 17 in the sleeve 16 pushes the roller wheel 19 in the direction of the second position that is stable over time and the operating lever 14 moves in the second position that is stable over time into an idle position, as illustrated in FIG. 5*g*.

The apparatus in accordance with the exemplary embodiment in FIG. 4 and FIG. 5 renders possible a signal change as already discussed with regard to FIG. 2, wherein the operating lever 14 moves from the first position that is stable over time at the peak point, which causes a first signal change and moves subsequently from the peak point to the second position that is stable over time, which defines a second signal change.

The signal change in the case of the exemplary embodiment in FIG. 4 and FIG. 5 is performed, as already discussed, during the transition from the first signal change to the second signal change, wherein the temporal interval between the first signal change and the second signal change lies in a relatively small, predetermined range and, for example, is approximately always of an equal length, for example, in a range of ±5%.

The temporal interval between the first signal change and the second signal change is always of identical length in a predetermined range since in accordance with the exemplary embodiment in FIG. 4 and FIG. 5 it is not possible manually to hold the contact closed for a longer period of time. The dwell time of the operating lever 14 at the peak point can in some exemplary embodiments depend upon factors such as resilient constants of the spring 17, the geometry and the material of the roller wheel 19 and the associated friction effects, also between the receiving arrangement 18 and the electrical jumper 24 or the housing 25.

The signal transmitter is actuated by means of a mechanical operating element, as discussed above, between at least a first position that is stable over time and a second position that is stable over time. It is however also possible to actuate a signal transmitter, wherein a mechanical operating element comprises multiple positions that are stable over time. This can be the case, for example, in the case of a rotary switch that can comprise a multiplicity of positions that are stable over time.

Figure 6:
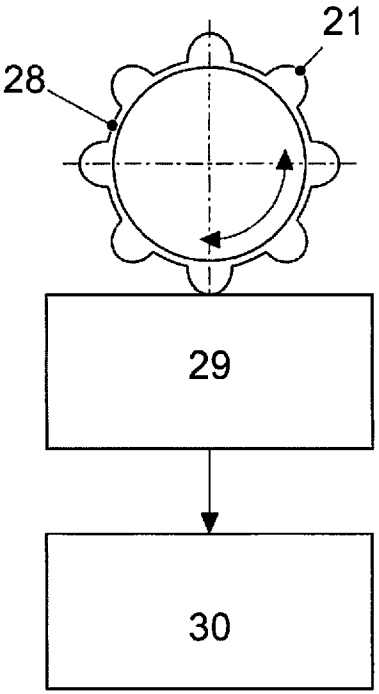
FIG. 6 illustrates the functional principle of a rotary switch of a disclosed apparatus.

FIG. 6 illustrates the function principle of a rotary switch of an apparatus in accordance with an exemplary embodiment, wherein the rotary switch comprises a mechanical rotary switch 28, wherein the rotary switch 28 comprises a cam profile.

The actuating cam 21 in FIG. 6 can be arranged both in a radial and also axial manner.

The actuating cam 21 that is attached to the rotary switch 28 can actuate a button element 29 when as a result of a rotary movement of the rotary switch 28 in each case always an actuating cam 21 moves from a first position that is stable over time into a second position that is stable over time. As a consequence, the button element 29 is actuated by means of in each case an actuating cam 21.

By way of the button element 29, an electrical output signal is generated by virtue of the actuation of the rotary switch 28 by way of an evaluation circuit.

In the case of some exemplary embodiments, the button element can comprise a membrane key 13, for example, such as the membrane key 13 discussed with regard to FIG. 3.

Figure 7:
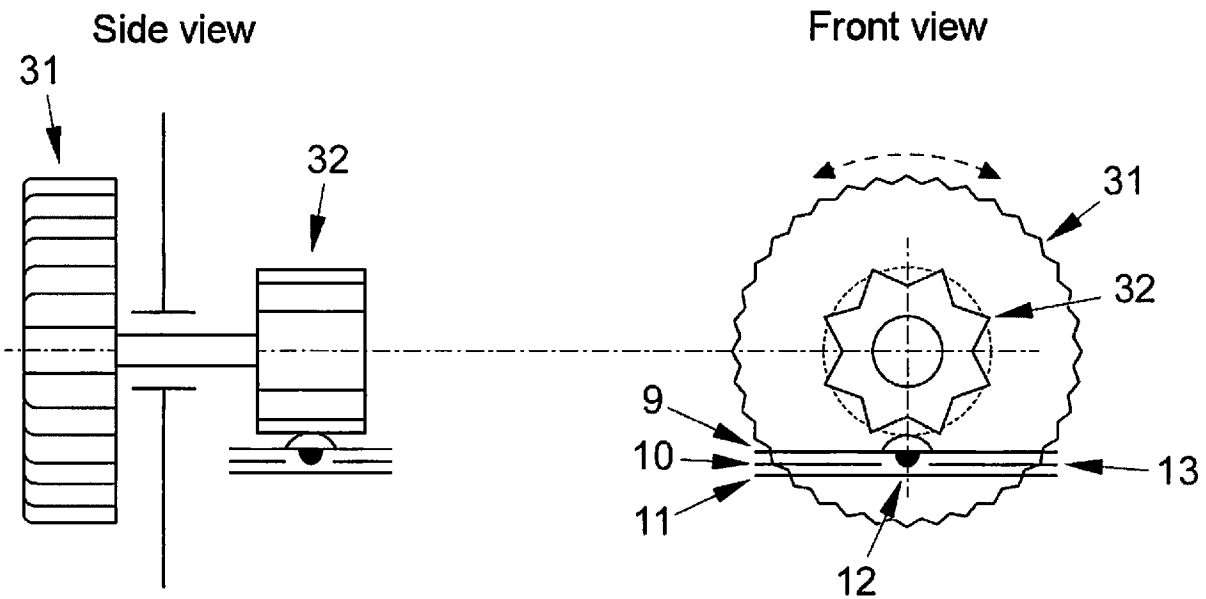
FIG. 7 illustrates a schematic illustration of a rotary switch having a radial cam profile in accordance with an exemplary embodiment.

FIG. 7 illustrates an embodiment of the exemplary embodiment of the apparatus illustrated in FIG. 6, wherein a mechanical operating element is provided by means of a rotary wheel 31.

The rotary wheel 31 is connected by way of an axle to a profiled carrier, wherein the profiled carrier comprises a multiplicity of actuating cams 21, for example, the actuating cams 21 illustrated in FIG. 6, which consequently form a profiled carrier having a radial cam profile 32.

The profiled carrier having a radial cam profile 32 can perform a rotary movement by way of the rotary wheel 31, as a consequence of which in each case an actuating cam 21 always moves from a first position that is stable over time into a second position that is stable over time and as a consequence actuates the membrane key 13, which is provided at the side, by way in each case of an actuating cam 21.

By virtue of the rotary movement of the profiled carrier 32, the actuating cam 21 actuates the first electrode 9 of the membrane key 13 and consequently by way of the contact nipple 12 causes the contact to close, as a consequence of which an electrical output signal is generated, in other words the membrane key 13 is always then actuated when an actuating cam 21 of the profiled carried 32 passes over the membrane key 13. The allocation to different functions can be provided, for example, by means of software.

Figure 8:
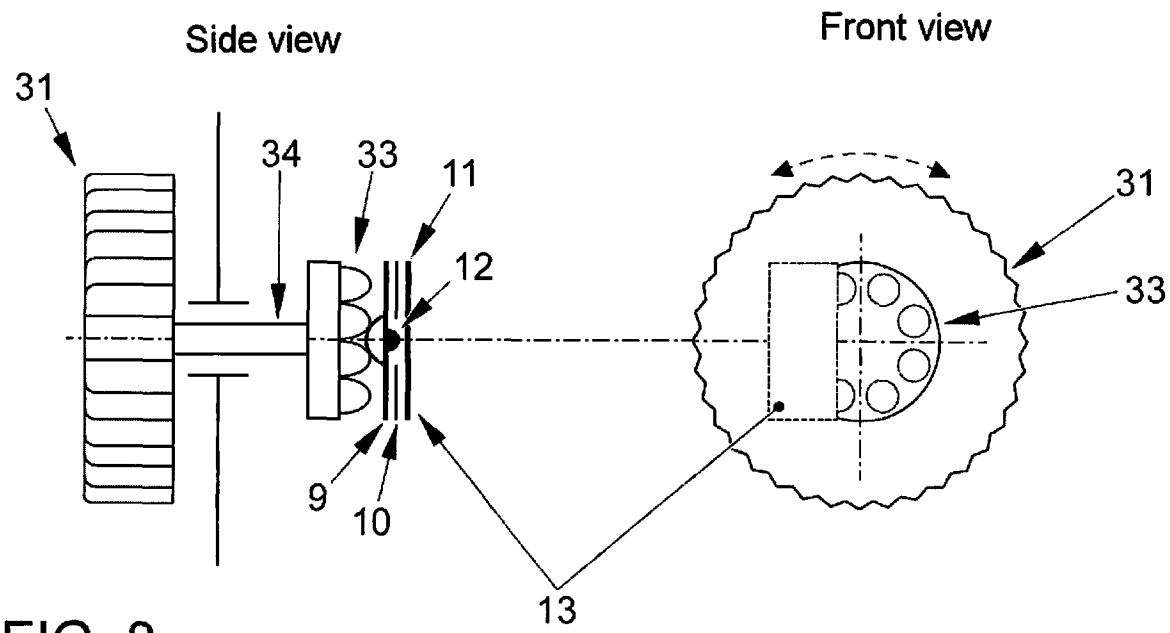
FIG. 8 illustrates a schematic illustration of a rotary switch having an axial cam profile in accordance with an exemplary embodiment.

FIG. 8 illustrates an embodiment of the exemplary embodiment of the apparatus illustrated in FIG. 6 according to claim 1, wherein a mechanical operating element is provided by means of a rotary wheel 31.

The rotary wheel 31 is connected by way of an axle to a profiled carrier, wherein the profiled carrier comprises a multiplicity of actuating cams 21, for example, comprises the actuating cams 21 that are illustrated in FIG. 6, which consequently form a profiled carrier having an axial cam profile 33.

The profiled carrier having an axial cam profile 33 can perform a rotary movement by way of the rotary wheel 31, as a consequence of which in each case an actuating cam 21 always moves from a first position that is stable over time into a second position that is stable over time and as a consequence by way of the actuating cam 21 actuates the membrane key 13 that is attached in front of the profiled carrier 33.

By virtue of the rotary movement of the profiled carrier 33, the actuating cam 21 actuates the first electrode 9 of the membrane key 13 and consequently by way of the contact nipple 12 causes the contact to close, as a consequence of which an electrical output signal is generated, in other words the membrane key 13 is always actuated when an actuating cam 21 of the profiled carrier 33 passes over the membrane key 13.

The allocation to different functions can be provided, for example, by means of software.

LIST OF REFERENCE NUMERALS

1 Apparatus
101 Mechanical operating element

102 Signal transmitter
103 Evaluation circuit
104 Electrical output signal
x Signal state
Z Time
A First signal change
B Second signal change
2 Button not pressed
3 Button pressed
4 Point in time at which the button is pressed
5 Point in time at which the button is released
6 Operating element toggle switch
7 Mounting arrangement toggle switch
8 Actuating cam
9 First electrode
10 Insulator
11 Second electrode
12 Contact nipple
13 Membrane key
14 Operating lever/key
15 Mounting arrangement
16 Sleeve
17 Spring
18 Receiving arrangement
19 Roller wheel
20 Running track
21 Actuating cam
22 Mounting arrangement
23 Release device
24 Electrical jumper
25 Housing of the electrical jumper
26 Contacts
27 Housing
28 Mechanical incremental rotary switch
29 Button element
30 Evaluation circuit
31 Operating element rotary wheel
32 Profiled carrier having a radial cam profile
33 Profiled carrier having an axial cam profile

The invention claimed is:

1. An actuating apparatus, comprising:

a signal transmitter that transmits an output signal; and a mechanical operating element, wherein the mechanical operating element comprises a first position that is stable over time and a second position that is stable over time, wherein the mechanical operating element actuates the signal transmitter in response to a movement from the first position to the second position, wherein, in response to the actuation by the mechanical operating element, the signal transmitter performs a first signal change followed by a second signal change of the output signal, wherein the actuating apparatus further comprises:

an evaluation circuit that detects an actuation of the mechanical operating element based on the first signal change and the second signal change, wherein a temporal interval between the first signal change and the second signal change lies within a predetermined range, and means for preventing actuation of the signal transmitter in response to the temporal interval being outside the predetermined range, and wherein the mechanical operating element comprises an operating lever and that the prevention means comprise a mounting arrangement, a sleeve, a spring, a receiving arrangement, a roller wheel, a running track and an actuating cam, wherein the operating lever is mounted on the sleeve by the mounting arrangement, wherein the sleeve comprises the spring, wherein the spring is connected to the roller wheel by a receiving arrangement, wherein the roller wheel moves freely in the running track between the first position and the second position, wherein, during the transition from the first position to the second position, the roller wheel passes an actuating cam mounted on the running track.

2. The actuating apparatus of claim 1, wherein the output signal is optical, electrical, magnetic or electromagnetic.

3. The actuating apparatus of claim 1, wherein the predetermined range lies within ±20% about the temporal interval.

4. The actuating apparatus of claim 1, further comprising an electrical jumper in a housing, wherein the electrical jumper in the housing comprises electrical contacts, and wherein the roller wheel is coupled to a release device by a mounting arrangement, wherein the release device is connected to the electrical jumper.

5. The actuating apparatus of claim 4, wherein, as the operating lever moves from the first position to the second position, the electrical jumper is closed at a peak point.

6. The actuating apparatus of claim 1, wherein the actuating cam actuates the signal transmitter.

7. An actuating apparatus, comprising:

a signal transmitter that outputs an electronic output signal;

a mechanical operating element, wherein the mechanical operating element comprises a first position that is stable over time and a second position that is stable over time, wherein the mechanical operating element actuates the signal transmitter in response to movement from the first position to the second position, and wherein the signal transmitter outputs a first signal change followed by a second signal change of the output signal in response to the actuation by the mechanical operating element;

an evaluation circuit that detects actuation performed by the mechanical operating element based on a temporal interval between the first signal change and the second signal change being within a predetermined range, and means for preventing actuation of the signal transmitter responsive to the temporal interval being outside of the predetermined range, wherein the mechanical operating element comprises an operating lever and the prevention means comprise a mounting arrangement, a sleeve, a spring, a receiving arrangement, a roller wheel, a running track and an actuating cam, wherein the operating lever is mounted on the sleeve by the mounting arrangement, wherein the sleeve comprises the spring, wherein the spring is connected to the roller wheel by a receiving arrangement, wherein the roller wheel moves freely in the running track between the first position and the second position, wherein, during the transition from the first position to the second position, the roller wheel passes an actuating cam mounted on the running track.

8. The actuating apparatus of claim 7, further comprising an electrical jumper in a housing, wherein the electrical jumper in the housing comprises electrical contacts, and wherein the roller wheel is coupled to a release device by the mounting arrangement, wherein the release device is connected to the electrical jumper.

9. The actuating apparatus of claim 8, wherein, as the operating lever moves from the first position to the second position, the electrical jumper is closed at a peak point.

10. The actuating apparatus of claim 7, wherein the predetermined range lies within ±20% about the temporal interval.

* * * * *